US007803038B2

(12) United States Patent
Lake

(10) Patent No.: US 7,803,038 B2
(45) Date of Patent: Sep. 28, 2010

(54) KNIFE MAINTENANCE APPARATUS

(76) Inventor: Ronald W. Lake, 3360 Bendix Ave., Eugene, OR (US) 97401-5825

( * ) Notice: Subject to any disclaimer, the term of this patent is extended or adjusted under 35 U.S.C. 154(b) by 640 days.

(21) Appl. No.: 11/881,573

(22) Filed: Jul. 27, 2007

(65) Prior Publication Data

US 2008/0026682 A1 Jan. 31, 2008

Related U.S. Application Data

(60) Provisional application No. 60/833,606, filed on Jul. 28, 2006.

(51) Int. Cl.
*B24B 3/52* (2006.01)

(52) U.S. Cl. ..... 451/321; 76/82.2; 451/552; 451/556

(58) Field of Classification Search ..... 76/82, 76/82.2; 451/45, 319, 321, 552, 556
See application file for complete search history.

(56) References Cited

U.S. PATENT DOCUMENTS 4,719,722 A * 1/1988 Washburn ..... 451/557
5,458,534 A 10/1995 Campione et al.
5,477,753 A 12/1995 Branscum et al.
6,062,970 A * 5/2000 Back ..... 451/556
6,997,795 B2 2/2006 Friel
7,104,876 B1 * 9/2006 Lin ..... 451/312
7,229,345 B2 6/2007 Fierus et al.

* cited by examiner

*Primary Examiner*—Timothy V Eley
(74) *Attorney, Agent, or Firm*—Teri G. Andrews

(57) ABSTRACT

A knife maintenance apparatus has a substantially rectangular hone body, a length with an open end and a base end, a width, a top surface covered with an abrasive material, and a bottom surface. There is a first hone edge extending along the length of the hone body and has a first radius. The opposite edge has a second radius and is parallel to and approximately the length of the first hone edge. The first hone edge and the second hone edge are approximately the hone body width apart. There is also a rectangular base portion that has a base top surface, a base bottom surface, a base width approximate the width of the hone body. The base portion has a sliding portion adjacent to and parallel to the base top surface. The base portion is hingably attached to the hone body along the base end and has at least one adjustment hole disposed through both the base portion and the sliding portion. There is at least one adjustment pin that extends through the adjustment hole. There is an adjustment arm hingably attached at one end to the open end of the hone body and hingably attached at a second end to the sliding portion. There is at least one knife maintenance tool removeably fixed on the adjustment arm. When the knife sharpening apparatus is in a closed position, the hone body, the base portion, and the sliding portion are substantially parallel. When the hone body is opened, the sliding portion slides along and parallel to the base top surface and can be latched in position by placing the adjustment pin through one of the adjustment holes to lock the hone body at an angle appropriate for sharpening a knife.

21 Claims, 4 Drawing Sheets

KNIFE MAINTENANCE APPARATUS

CROSS-REFERENCE TO RELATED APPLICATION

This application claims the benefit of Provisional Patent Application No. 60/833,606, filed Jul. 28, 2006, by the present inventor.

BACKGROUND OF THE INVENTION

1. Field of the Invention

This invention relates to knife maintenance apparatuses, and more particularly to a knife maintenance apparatus that sharpens or hones the blades of knives as well as provides needed tools to maintain the entire knife.

2. Prior Art

The maintenance of kitchen knives or sportsman's knives requires certain unique tools. These tools often include a sharpening or honing stone or other abrasive surface to sharpen the blade; a quantity of oil that can be used for lubricating pocket knives, fishing reels, multi-tools, etc.; and a variety of hex head, torque, or slotted screw or bolt drivers to tighten, adjust and repair all types of knives and blades. Additionally, there are different abrasive requirements for various knife blade materials which each may require a different grade or coarseness of a sharpening surface. This requires a variety of sharpening or honing devices.

Most users of compact field knives, folding knives, and household knives typically have most of these components spread out around their house or shop. Unfortunately, at the time any one particular component is needed, it is often not the one readily available. It would be desirable to have a compact kit or apparatus that would address all honing and cutlery maintenance needs whether in the home, the shop, or out in the field.

Knife honing devices that are useful in the field need to be small enough to slip into a knapsack or a vest pocket. Within the current technology, these are typically a small, basic stone or sharpening steel. For the unskilled sharpener, this presents a problem if the correct sharpening angle is not maintained while attempting to sharpen a dull blade. Often this unskilled attempt results in a duller or damaged blade rather than a sharper one.

Although some may be skilled enough to put a decent edge on a straight blade, few have the required skills or tools to sharpen a serrated blade, such as a bread knife. Often field knives also have a few serrations on the base edges opposite the knife tip. When these serrations become dull, the only sharpening option is to have them professionally sharpened. This can be both expensive as well as inconvenient.

Within the currently available technology, there is not a single apparatus that contains all of the aforementioned common knife maintenance tools suited for compact field use, folding knives, and household use.

3.Objects And Advantages

The primary object of the present invention is to provide a knife maintenance apparatus that is designed to address all honing and cutlery maintenance needs. It is also an object of the present invention to provide a knife maintenance apparatus that is suited for compact field use, folding knife maintenance, and household use.

It is a further object of the present invention to provide a knife maintenance apparatus that gives even a novice knife user the ability to put a sharp edge on a knife blade whether it is a straight or a serrated edged knife in a manner that is faster, easier, and more accurate than the existing manual knife sharpeners.

It is yet another object of the present invention to provide a knife maintenance apparatus that contains all of the necessary tools for basic knife maintenance while maintaining a lightweight and compact size.

It is also an object of the present invention to provide a knife maintenance apparatus that can provide all of the aforementioned needs while maintaining simplicity of construction; therefore, minimizing manufacturing costs.

SUMMARY OF THE INVENTION

The present invention discloses a knife maintenance apparatus that has a substantially rectangular hone body that has a length with an open end and a base end, a width, a top surface covered with an abrasive material, and a bottom surface. There is a first hone edge extending along the length of the hone body and has a first radius. The opposite edge has a second radius and is parallel to and approximately the length of the first hone edge. The first hone edge and the second hone edge are approximately the hone body width apart. There is also a rectangular base portion that has a base top surface, a base bottom surface, a base width approximate the width of the hone body. The base portion has a sliding portion adjacent to and parallel to the base top surface. The base portion is hingably attached to the hone body along the base end and has at least one adjustment hole disposed through both the base portion and the sliding portion. There is at least one adjustment pin that extends through the adjustment hole. There is an adjustment arm hingably attached at one end to the open end of the hone body and hingably attached at a second end to the sliding portion. There is at least one knife maintenance tool removeably fixed on said adjustment arm. When the knife sharpening apparatus is in a closed position, the hone body, the base portion, and the sliding portion are substantially parallel. When the hone body is opened, the sliding portion slides along and parallel to the base top surface and can be latched in position by placing the adjustment pin through one of the adjustment holes to lock the hone body at an angle appropriate for sharpening a knife.

BRIEF DESCRIPTION OF THE DRAWINGS—IN THE DRAWINGS

The above description and other objects, advantages, and features of the present invention will be more fully understood and appreciated by reference to the specification and accompanying drawings, wherein.

DRAWINGS—Reference Numerals.

| | |
|---|---|
| 100 | Knife Maintenance Apparatus |
| 102 | Hone Body |
| 104 | Adjustment Arm |
| 105 | Pivot Lobe |
| 106 | Adjustment Sliding Portion |
| 107 | Pivot Shoulder Pin |
| 108 | Base |
| 109 | Pivot Pin Spring |
| 110 | Lower Hinge Pin |
| 112 | Upper Hinge Pin |
| 202 | First Radiused Edge |
| 204 | Second Radiused Edge |
| 302 | Retaining Flange Slot |
| 304 | Retaining Flange |
| 402 | Piston Travel Slot |
| 404 | Piston Depression Channel |
| 406 | Adjustment Pockets |
| 502 | Adjustment Piston |
| 504 | Piston Spring |
| 506 | Piston and Spring Housing |
| 600 | Preferred Adjustment Arm |
| 602 | Screw/Bold Drivers |
| 604 | Clearance Hole |
| 606 | Push Out Holes |
| 608 | Oiler |
| 702 | Vertical Honing Cradle |
| 704 | Hone Body Support |
| 706 | Vertical Nest |

DETAILED DISCUSSION OF THE PRESENT INVENTION

Referring to the figures, like elements retain their indicators throughout the several views.

Figure 1:
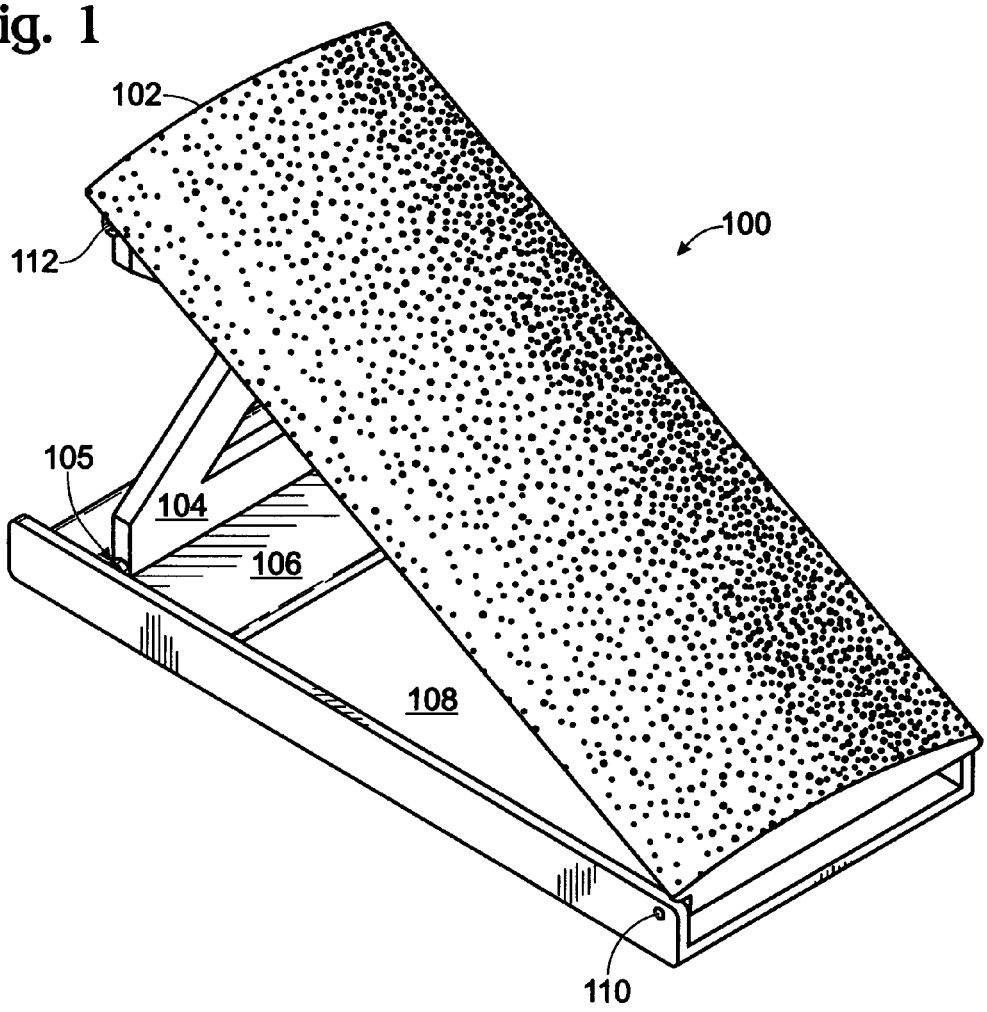
FIG. 1 is a perspective view of a knife maintenance apparatus in accordance with the present invention showing the apparatus in the open position for sharpening a knife.

FIG. 1 is a perspective view of Knife Maintenance Apparatus 100 in accordance with the present invention showing Knife Maintenance Apparatus 100 in the open position at an angle appropriate for sharpening a knife. Hone Body 102 is covered with an abrasive material such as diamond, cubic boron nitride, or the like.

Although FIG. 1 depicts Hone Body 102 as a single piece, in an alternate embodiment, Hone Body 102 is constructed of a base material and a cover that covers the entire upper surface and over the radiused edges. The base material can be of any material strong enough to withstand the pressure of dragging a knife blade over the surface such as plastic, metal, or fiberglass. The cover is made of a sheet metal and coated or embedded with an abrasive, such as diamond, cubic boron nitride, or the like. The bent angles on either side of the cover act to retain the cover on the base hone body. The cover can be replaced when worn or can be exchanged with a differing cover that may perform a different sharpening quality for different types of metal blades. Most of the components of Knife Maintenance Apparatus 100 are designed to be made of molded or cast parts and can be either plastic or metal.

In an alternate embodiment, Knife Maintenance Apparatus 100 has an indentation or groove disposed the length of and approximately centered in Hone Body 102. This groove is for sharpening pointed tools such as awls, center punches or scribes. Fishing hooks could also be sharpened in this abrasive coated groove.

Typically, blades are sharpened with either a sharpening steel or a honing stone. The user must be skilled at maintaining the optimal angle between the sharpening device and the knife blade in order to get a fine, sharp blade. With the present invention, the user merely has to hold the knife blade horizontal and run it down and along Hone Body 102. Hone Body 102 is opened and locked into one of the several adjustable positions the user chooses to provide the correct angle for the job at hand. With the present invention, the ability to easily remove the cover from Hone Body 102 allows the user to practice holding the knife at the correct angle before attempting to sharpen the blade. This non-abrasive sharpening practice will likely save the blade from unnecessary reduction, damage, or further dulling.

Base 108 is shown hingably attached by Lower Hinge Pin 110 to Hone Body 102. Adjustment Sliding Portion 106 slides along the top surface of and parallel to Base 108. Adjustment Sliding Portion 106 has two Pivot Lobes 105 extending above Adjustment Sliding Portion 106. Adjustment Arm 104 is hingably attached at one end to Hone Body 102 by Upper Hinge Pins 112 and at the opposite end at Pivot Lobe 105 by Pivot Should Pins 107 (not shown). As Knife Maintenance Apparatus 100 is pulled to a sharpening or open position, Adjustment Sliding Portion 106 slides away from Lower Hinge Pin 110 as Adjustment Arm 104 becomes more vertical, thereby increasing the sharpening angle of Hone Body 102. When the desired angle is reached, Adjustment Sliding Portion is locked into place by a latching means (see FIGS. 4 and 5 detailed discussion) to secure the selected angle during sharpening.

To close and stow Knife Maintenance Apparatus 100, the latching means is released and Adjustment Sliding Portion 106 slides toward Lower Hinge Pin 110 thereby collapsing Knife Maintenance Apparatus 100 into a flat, compact kit. In the closed form, Knife Maintenance Apparatus 100 can be easily slipped into a pocket for field use or a thin drawer for kitchen or shop storage.

Figure 2:
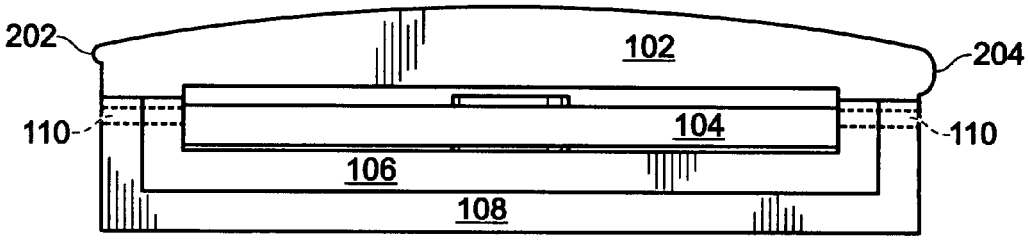
FIG. 2 is an end view of the knife maintenance apparatus of the present invention in the closed position.

FIG. 2 is the base end view of Knife Maintenance Apparatus 100 of the present invention in the closed position. Hone Body 102 is shown in a somewhat convex shape for honing worn or recurved blades. Although this is a preferred shape that is useful for reaching all edges of a knife blade, it has also been contemplated to have Hone Body 102 more flat in the center and slightly sloping off to the outer edges.

First Radiused Edge 202 is shown with a fairly small radius. This is useful for sharpening knives with narrower, shallow serrations or similar curved blades. Second Radiused Edge 204 has a radius larger than the radius of First Radiused Edge 202 to accommodate knives with wider, deeper serrations. To sharpen serrated edged knives, Knife Maintenance Apparatus 100 is laid on its side either open or closed and each serration drawn along either First Radiused Edge 202 or Second Radiused Edge 204—depending upon the shape of the serrations on the knife.

The shape of Hone Body 102 for straight and curved knives and the varying radiuses of the edges of Hone Body 102 for serrated knives, easily take the place of at least three blade sharpening tools.

Lower Hinge Pin 110 extends through Hone Body 102 and into Base 108 thereby allowing the angle of Hone Body 102 relative to Base 108 to be easily altered to suit substantially all knife sharpening needs.

As depicted in FIG. 2, when Knife Maintenance Apparatus 100 is closed or collapsed, Hone Body 102, Adjustment Arm 104, Adjustment Sliding Portion 106 and Base 108 lay substantially parallel to one another to create a very thin, compact device.

Figure 3:
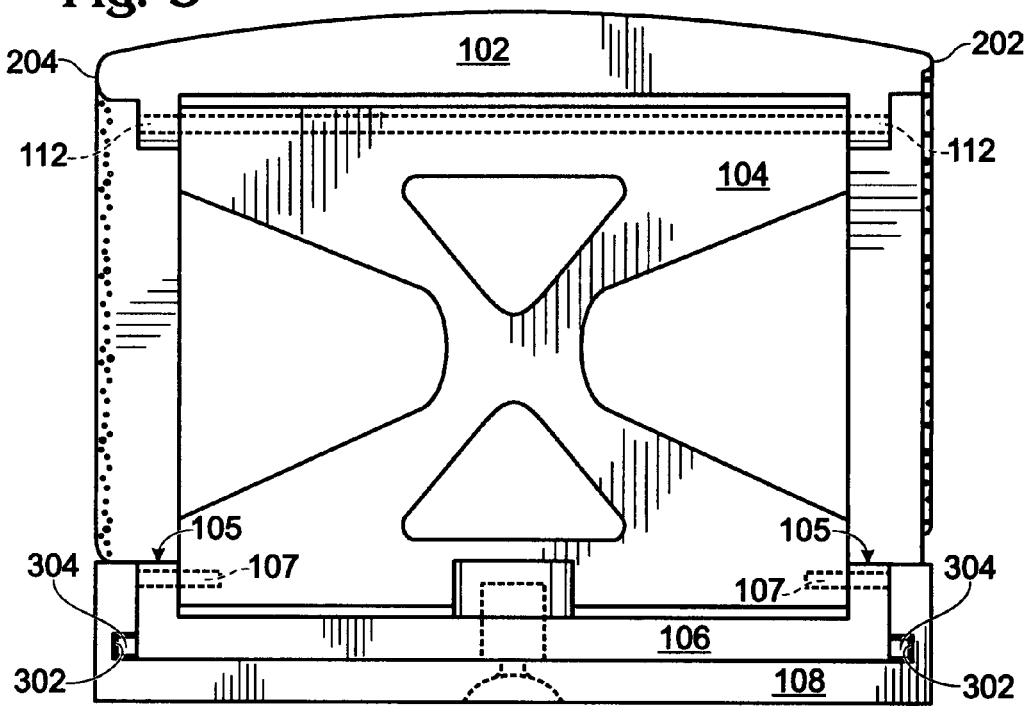
FIG. 3 is an end view of the knife maintenance apparatus of the present invention in the open position.

FIG. 3 is an end view of Knife Maintenance Apparatus 100 of the present invention in the open position. Adjustment Sliding Portion 106 has two Retaining Flanges 304 that extend along the outer base edges. Retaining Flanges 304 slip into Retaining Flange Slots 302 disposed along the interior edges of Base 108. Retaining Flanges 304 control the sliding action of Adjustment Sliding Portion 106 allowing smooth movement along Base 108 without twisting or lifting. Pivot Shoulder Pins 107 are shown in phantom and extend through Pivot Lobes 105 on either side of Adjustment Sliding Portion 106 and into Adjustment Arm 104 allowing hinged movement between Adjustment Arm 104 and Adjustment Sliding Portion 106 when varying the angle of Hone Body 102.

Figure 4:
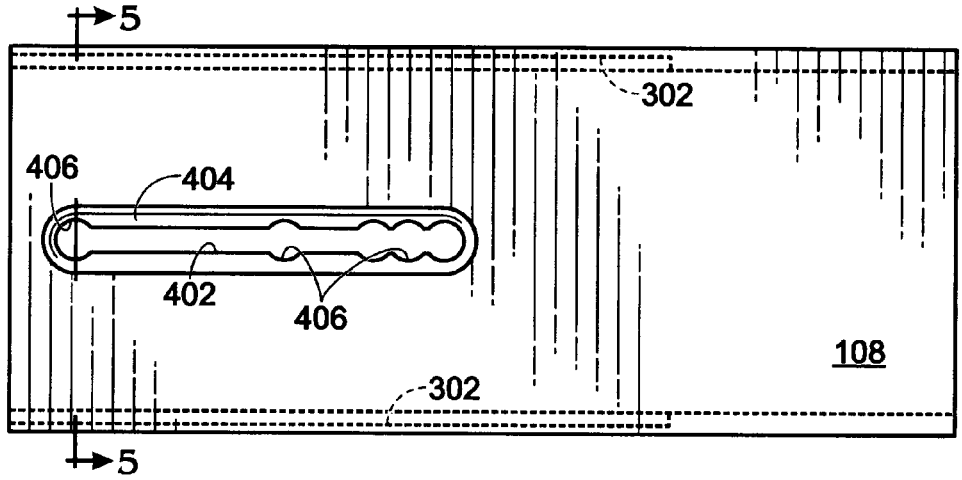
FIG. 4 is a bottom view of the knife maintenance apparatus of the present invention depicting the adjustment slot used for varying the sharpening angle.

FIG. 4 is a bottom view of Base 108 of Knife Maintenance Apparatus 100 of the present invention. Piston Travel Slot 402 is a through slot down the center of Base 108. Piston Depression Channel 404 is a domed relief along Piston Travel slot 402 that allows a finger or thumb to slide Adjustment Piston 502 (not shown) to various Adjustment Pockets 406. Each Adjustment Pocket 406 is identified for a pre-set angle for edge honing with the outer most Adjustment Pocket 406 being fully open and the inner most Adjustment Pocket 406 being fully closed.

Retaining Flange Slot 302 is shown in phantom along both inner edges of Base 108. This is the travel slot for Retaining Flange 304 of Adjustment Sliding Portion 106 when moving between the open and closed positions.

Figure 5:
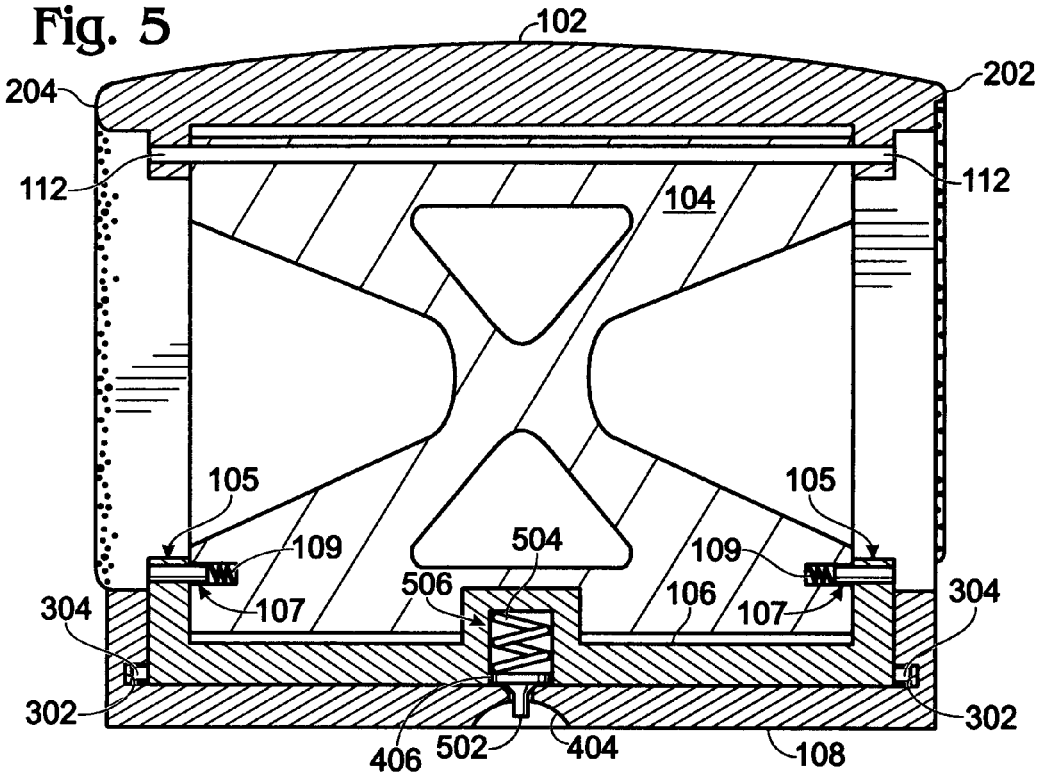
FIG. 5 is a cross-sectional view taken along line 5-5 of FIG. 4.

FIG. 5 is a cross-sectional view of Knife Maintenance Apparatus 100 taken along line 5-5 of FIG. 4. Adjustment Piston 502 is nested in the outer most Adjustment Pocket 406 where Knife Maintenance Apparatus 100 is fully open. Piston Spring 504 is contained within Piston and Spring Housing 506 and holds Adjustment Piston 502 in a selected Adjustment Pocket 406 with spring force. To reposition Adjustment Piston 502 and thereby change the angle of Hone Body 102, the user presses Adjustment Piston 502 up with a finger or thumb. This raises Adjustment Piston 502 above Base 108 and allows Adjustment Sliding Portion 106 to slide freely the length of Piston Travel Slot 402 with the user finger or thumb sliding along Piston Depression Channel 404.

The FIG. 5 cross-section also shows Pivot Pin Spring 109 internal to Adjustment Arm 104 that keep Pivot Shoulder Pin 107 biased toward the outer edge of Pivot Lobe 105 while facilitating the hinged movement of Adjustment Arm 104 between the open and closed positions.

Figure 6:
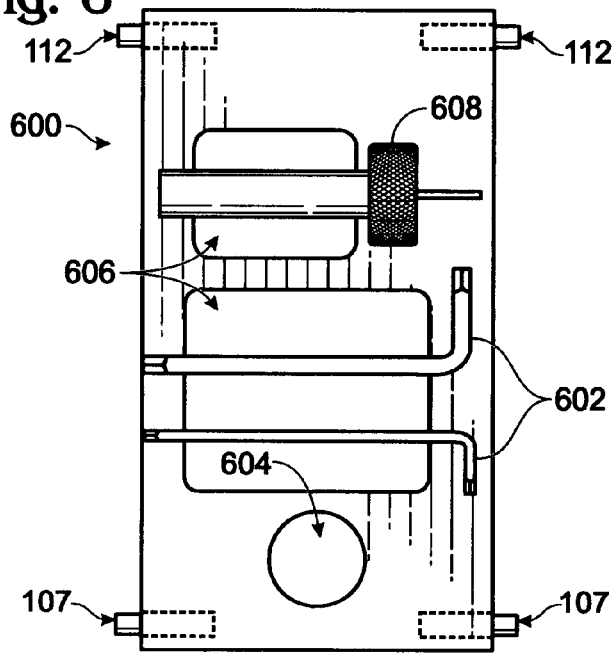
FIG. 6 is a top view of the preferred adjustment arm of the present invention depicting a variety of knife maintenance tools that can be included in the knife maintenance apparatus of the present invention.

FIG. 6 is a top view of Preferred Adjustment Arm 600 of the present invention depicting a variety of knife maintenance tools that can be included in Knife Maintenance Apparatus 100 of the present invention. Although several tools are disposed in Preferred Adjustment Arm 600, Knife Maintenance Apparatus 100 still closes to a minimal, flat thickness as it does with Adjustment Arm 104. Preferred Adjustment Arm 600 has suitable pockets or nests for each corresponding maintenance tool. FIG. 6 shows Oiler 608 for lubricating pocket knives, fishing reels, multi-tools, etc. There are also Screw/Bold Drivers 602 nested on Preferred Adjustment Arm 600. Screw/Bold Drivers 602 can be torx, hex, or slotted screwdrivers. The design also could accommodate small box-end or open-end wrenches. To remove the tools and Oiler 608, the user simply places a finger behind Preferred Adjustment Arm 600 and through Push Out Holes 606 and with sufficient pressure dislodges the needed tool or oiler. A corresponding clearance pocket (not shown) may be necessary in the bottom surface of Hone Body 102 to accommodate the diameter of Oiler 608. By placing maintenance tool in Preferred Adjustment Arm 600, they are concealed and free from dislodging once Knife Maintenance Apparatus 100 is folded closed.

Figure 7:
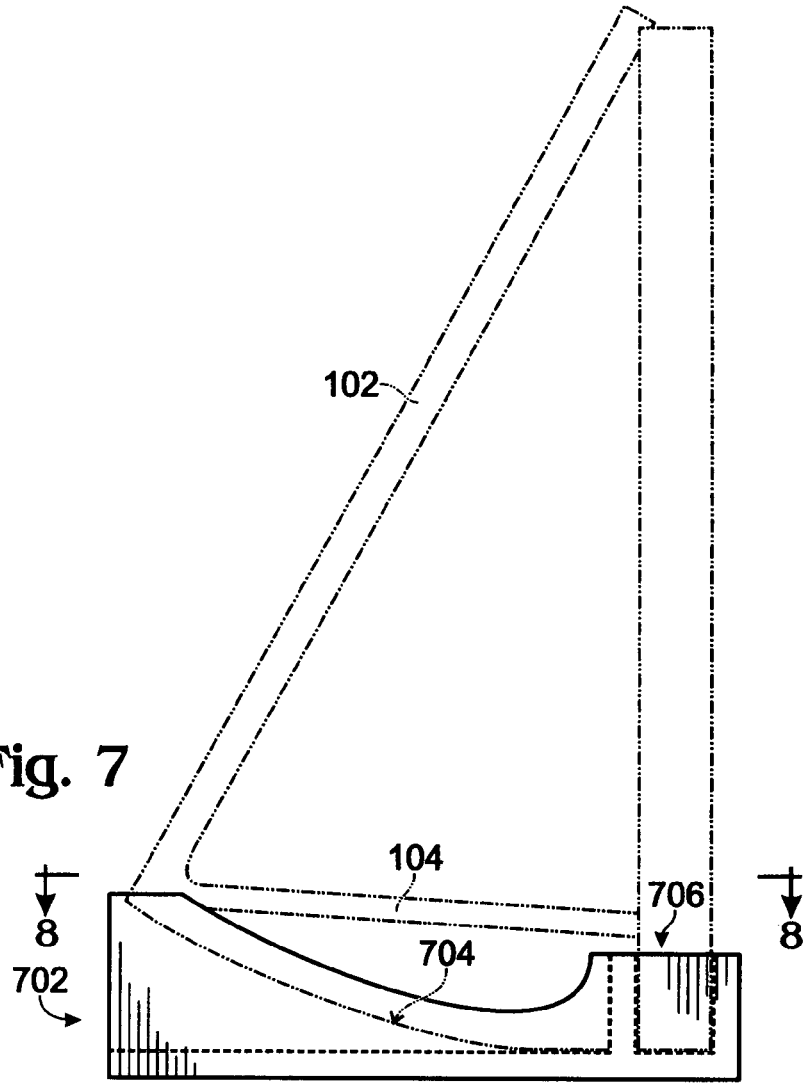
FIG. 7 is side view of the vertical honing cradle of the present invention that allows the knife maintenance apparatus to also function in a more vertical arrangement.

FIG. 7 is side view of Vertical Honing Cradle 702 of the present invention. Vertical Honing Cradle 702 is designed for those who prefer to hold a knife to be honed in the vertical position. Base 108 fits into Vertical Nest 706. Hone Body 102 is supported by Hone Body Support 704 that is somewhat ramped to support all angles selected for Hone Body 102.

Figure 8:
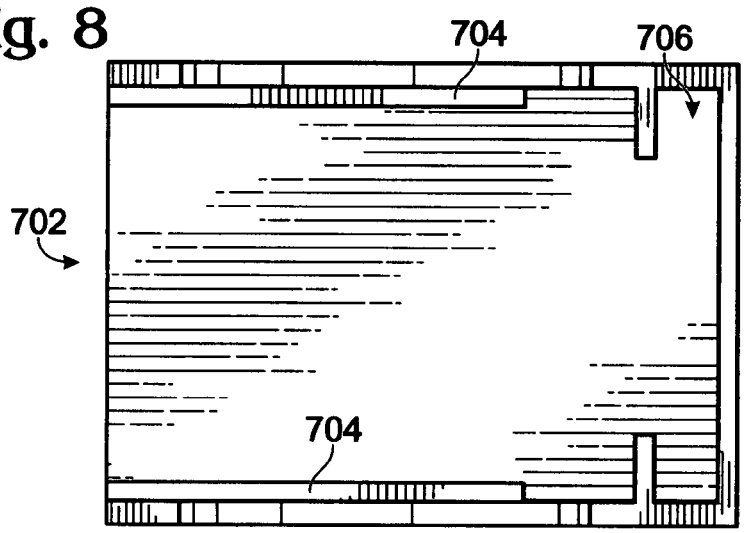
FIG. 8 is a top view of the vertical honing cradle of the present invention.

FIG. 8 is a top plan view of Vertical Honing Cradle 702 of the present invention. With Hone Body Support 704 shown disposed on the outer, interior edges of Vertical Honing Cradle 702. Vertical Nest 706 corresponds to the thickness and width of Base 108 thereby holding Knife Maintenance Apparatus 100 firmly in a vertical position as shown in FIG. 8.

Alternate embodiments of Knife Maintenance Apparatus 100 have been contemplated that vary in size to suit many needs. For example, in a smaller version, Knife Maintenance Apparatus 100 can be mounted to or be part of a motor body or housing that vibrates, oscillates, or some other suitable motion to satisfy the sharpening process.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A Knife Maintenance Apparatus, comprising:

a substantially rectangular hone body having a length having an open end and a base end, a width, a top surface covered with an abrasive material, a bottom surface, a first hone edge extending along said length of said hone body and having a first radius, a second hone edge having a second radius and approximate the length of and parallel to said first hone edge, said first hone edge and said second hone edge being said width apart;

a substantially rectangular base portion having a base top surface, a base bottom surface, a base width approximate said width of said hone body, a sliding portion adjacent to and parallel to said base top surface, said base portion hingably attached to said hone body along said base end and having at least one adjustment hole disposed through both said base portion and said sliding portion;

at least one adjustment pin that extends through said adjustment hole; and an adjustment arm hingably attached at a first arm end to said open end of said hone body and hingably attached at a second arm end to said sliding portion;

wherein, when the knife sharpening apparatus is in a closed position, said hone body, said base portion, and said sliding portion are substantially parallel, when said hone body is hingably opened, said sliding portion slides along and parallel to said base top surface and can be latched in position by placing said adjustment pin through one of said at least one adjustment hole to lock said hone body at an angle appropriate for sharpening a knife.

2. The Knife Maintenance Apparatus of claim 1, further comprising:

at least one knife maintenance tool removably attached to said adjustment arm.

3. The Knife Maintenance Apparatus of claim 2, wherein said maintenance tool is an oiling device.

4. The Knife Maintenance Apparatus of claim 2, wherein said maintenance tool is a screw fastening device.

5. The Knife Maintenance Apparatus of claim 2, wherein said maintenance tool is a bolt fastening device.

6. The Knife Maintenance Apparatus of claim 1, further comprising:

at least one hone body cover that covers said top surface of said hone body and wraps around said first radius and said second radius thereby holding said hone body cover in place, wherein said hone body cover is interchangeable with other said hone body covers each having a unique abrasive surface for sharpening blades.

7. The Knife Maintenance Apparatus of claim 6, wherein said hone body cover is made of sheet metal coated with diamond.

8. The Knife Maintenance Apparatus of claim 6, wherein said hone body cover is made of sheet metal coated with cubic boron nitride.

9. The Knife Maintenance Apparatus of claim 1, wherein said base portion, said hone body, said adjustment arm, and said sliding portion are made of molded plastic.

10. The Knife Maintenance Apparatus of claim 1, wherein said base portion, said hone body, said adjustment arm, and said sliding portion are made of cast aluminum.

11. The Knife Maintenance Apparatus of claim 1, wherein said base portion, said hone body, said adjustment arm, and said sliding portion are made of cast steel.

12. A Knife Maintenance Apparatus, comprising:

a substantially rectangular hone body base having, a body top surface, a length having an open end and a base end, a width, a bottom surface, a first hone edge extending along said length of said hone body and having a first radius, a second hone edge having a second radius and approximate the length of and parallel to said first hone edge, said first hone edge and said second hone edge being said width apart;

a hone body cover embedded with an abrasive material, said hone body cover covering said body top surface, said first radius and said second radius along said first hone edge and said second hone edge;

a substantially rectangular base portion having a base top surface, a base bottom surface, a base width approximate said width of said hone body base, a sliding portion adjacent to and parallel to said base top surface, said base portion hingably attached to said hone body base along said base end and having at least one adjustment hole disposed through both said base portion and said sliding portion;

at least one adjustment pin that extends through said adjustment hole; and an adjustment arm hingably attached at a first arm end to said open end of said hone body and hingably attached at a second arm end to said sliding portion;

wherein, when the knife sharpening apparatus is in a closed position, said hone body base, said base portion, and said sliding portion are substantially parallel, when said hone body is hingably opened, said sliding portion slides along and parallel to said base top surface and can be latched in position by placing said adjustment pin through one of said at least one adjustment hole to lock said hone body at an angle appropriate for sharpening a knife.

13. The Knife Maintenance Apparatus of claim 12, further comprising:

at least one knife maintenance tool removably attached to said adjustment arm.

14. The Knife Maintenance Apparatus of claim 13, wherein said maintenance tool is an oiling device.

15. The Knife Maintenance Apparatus of claim 13, wherein said maintenance tool is a screw fastening tool.

16. The Knife Maintenance Apparatus of claim 13, wherein said maintenance tool is a bolt fastening device.

17. The Knife Maintenance Apparatus of claim 12, wherein said hone body cover is made of sheet metal coated with diamond.

18. The Knife Maintenance Apparatus of claim 12, wherein said hone body cover is made of sheet metal coated with cubic boron nitride.

19. The Knife Maintenance Apparatus of claim 12, wherein said base portion, said hone body base, said adjustment arm, and said sliding portion are made of molded plastic.

20. The Knife Maintenance Apparatus of claim 12, wherein said base portion, said hone body base, said adjustment arm, and said sliding portion are made of cast aluminum.

21. The Knife Maintenance Apparatus of claim 12, wherein said base portion, said hone body base, said adjustment arm, and said sliding portion are made of cast steel.

* * * * *